US005878883A

United States Patent [19]

Weder

[11] Patent Number: 5,878,883

[45] Date of Patent: Mar. 9, 1999

[54] THERMOPLASTIC SHIPPING DEVICE AND METHOD

[75] Inventor: Donald E. Weder, Highland, Ill.

[73] Assignee: Southpac Trust Interational, Inc.

[21] Appl. No.: 81,838

[22] Filed: May 19, 1998

Related U.S. Application Data

[63] Continuation of Ser. No. 867,431, May 30, 1997, Pat. No. 5,775,502.

[51] Int. Cl.[6] ..... B65D 85/52

[52] U.S. Cl. ..... 206/423; 206/460; 206/813; 53/452

[58] Field of Search ..... 206/423, 813, 206/460, 495; 47/72; 53/390, 396, 397, 410, 452, 461

[56] References Cited

U.S. PATENT DOCUMENTS

| | | | |
|---|---|---|---|
| 1,064,813 | 6/1913 | Bloomberg . | |
| 2,165,539 | 7/1939 | Dahlgren . | |
| 2,373,634 | 4/1945 | Wagner | 117/122 |
| 2,578,583 | 12/1951 | O'Brien . | |
| 2,664,670 | 1/1954 | Mulford | 47/37 |
| 2,707,352 | 5/1955 | Fischer | 47/58 |
| 2,721,022 | 10/1955 | Billerbeck | 229/52 |
| 2,744,624 | 5/1956 | Hoogstoel et al. . | |
| 2,871,080 | 1/1959 | Shelly | 312/107 |
| 3,113,673 | 12/1963 | Stein . | |
| 3,322,323 | 5/1967 | Green et al. | 229/37 |
| 3,374,884 | 3/1968 | Chinkes . | |
| 3,389,784 | 6/1968 | Hendricks et al. . | |
| 3,466,214 | 9/1969 | Polk et al. | 156/213 |
| 3,488,022 | 1/1970 | Vittori | 248/152 |
| 3,524,583 | 8/1970 | Gregory | 229/87 |
| 3,708,946 | 1/1973 | Cahill | 53/37 |
| 3,725,188 | 4/1973 | Kalt | 161/116 |
| 3,734,280 | 5/1973 | Amneus et al. | 206/65 R |
| 3,754,642 | 8/1973 | Stidolph | 206/45.14 |
| 3,883,990 | 5/1975 | Stidolph | 47/58 |
| 3,924,354 | 12/1975 | Gregoire | 47/34.11 |
| 4,053,049 | 10/1977 | Beauvais | 206/318 |
| 4,170,301 | 10/1979 | Jones et al. | 206/423 |
| 4,248,347 | 2/1981 | Trimbee | 206/423 |
| 4,396,120 | 8/1983 | Morita | 206/460 |
| 4,470,508 | 9/1984 | Yen | 206/334 |
| 5,065,922 | 11/1991 | Harris | 224/42.32 |
| 5,092,465 | 3/1992 | Weder et al. | 206/423 |
| 5,111,638 | 5/1992 | Weder | 53/397 |
| 5,148,918 | 9/1992 | Weder et al. | 206/423 |
| 5,195,637 | 3/1993 | Weder | 206/423 |
| 5,240,109 | 8/1993 | Weder et al. | 206/423 |
| 5,255,784 | 10/1993 | Weder et al. | 206/423 |
| 5,311,992 | 5/1994 | Weder et al. | 206/423 |
| 5,322,181 | 6/1994 | Nelson | 220/461 |
| 5,407,072 | 4/1995 | Weder et al. | 206/423 |
| 5,411,137 | 5/1995 | Weder et al. | 206/423 |
| 5,522,205 | 6/1996 | Weder | 53/475 |
| 5,564,567 | 10/1996 | Weder | 206/423 |
| 5,775,502 | 7/1998 | Weder | 206/423 |

FOREIGN PATENT DOCUMENTS

| | | |
|---|---|---|
| 192843 | 11/1957 | Austria . |
| 686577 | 12/1995 | European Pat. Off. . |
| 2221936 | 10/1974 | France . |
| 8026641 | 12/1980 | France . |
| 2735225 | 4/1978 | Germany . |
| 61058 | 6/1989 | Japan . |
| 4352664 | 12/1992 | Japan . |
| 8101464 | 3/1981 | Netherlands . |
| 26878 | 11/1913 | United Kingdom . |
| 432899 | 8/1935 | United Kingdom . |

OTHER PUBLICATIONS

Oasis Grower Products; Smithers–Oasis; Kent, OH; 1991.

*Primary Examiner*—Jacob K. Ackun
*Attorney, Agent, or Firm*—Dunlap, Codding & Rogers, P.C.

[57] ABSTRACT

A method and apparatus for preparing a floral assembly for shipment. Disposing at least one floral assembly on a shipping device formed from a thermoplastic or resinous material having a connecting bonding material thereon wherein the floral assembly is connectingly bonded to the shipping device.

38 Claims, 3 Drawing Sheets

THERMOPLASTIC SHIPPING DEVICE AND METHOD

This is a continuation of application Ser. No. 08/867,431, filed on May 30, 1997, now U.S. Pat. No. 5,775,502.

BACKGROUND

The present invention is related to methods for transporting various items such as floral containers, potted plants, and vases, wherein the items are bondingly connected to a surface having a bonding layer thereon for minimizing movement and disturbance of the items during transportation and devices used in such methods of transport.

DESCRIPTION OF THE PREFERRED EMBODIMENTS

Figure 1:
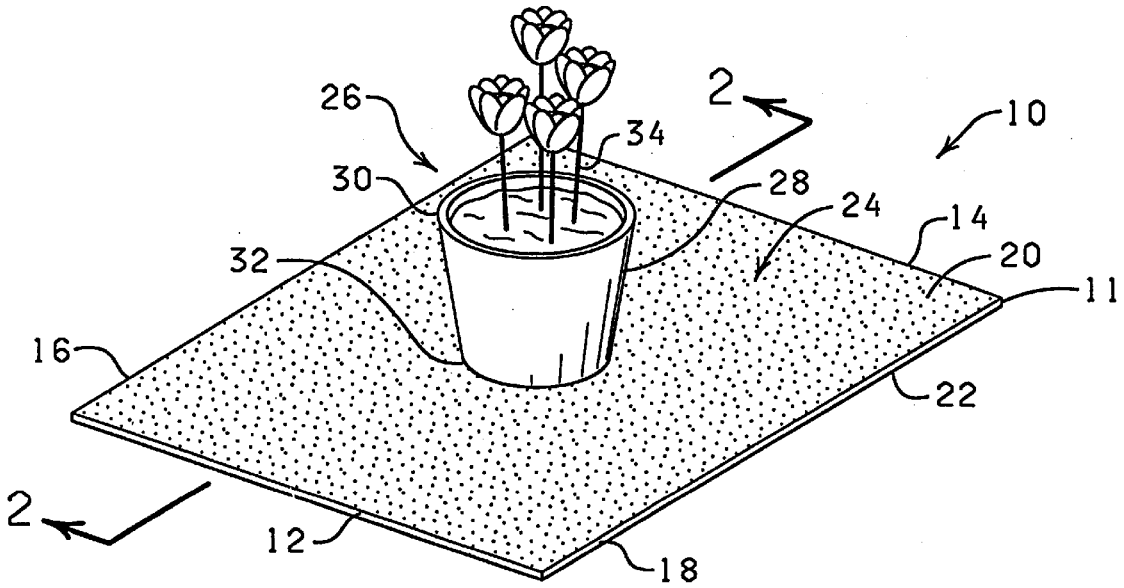
FIG. 1 is a perspective view of a shipping device constructed for use in accordance with the present invention.
Figure 2:
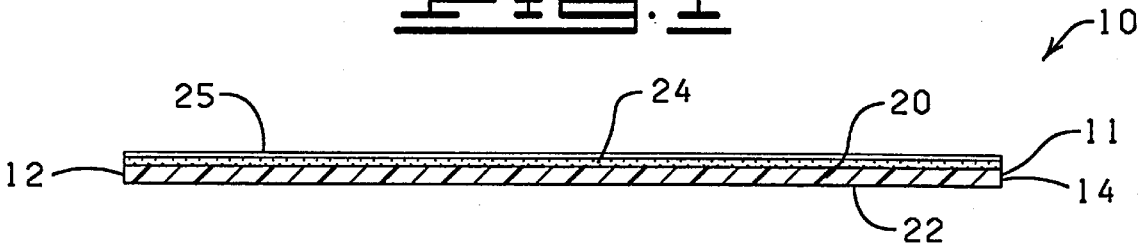
FIG. 2 is a side view of the shipping device of FIG. 1.

Shown in FIGS. 1 and 2 and designated therein by the reference numeral 10 is a shipping device comprising a sheet of a rigid or semi-rigid extruded thermoplastic material. The use of a plastic or resinous material avoids problems encountered in using cardboard as a shipping device. Cardboard has a tendency to delaminate and weaken when wet. Cardboard also tends to warp or curl as atmospheric conditions such as humidity and barometric pressure change. The shipping device 10 in one embodiment comprises a sheet 11 which has a first edge 12, a second edge 14, a third edge 16 and a fourth edge 18. The sheet 11 has an upper surface 20 and a lower surface 22. Disposed upon at least a portion of the upper surface 20 is a bonding material 24. A removable layer of release (masking) material 25 may be disposed upon the bonding material 24 (see FIG. 2) to protect the bonding properties of the bonding material 24 prior to use of the device 10. The shipping device 10 is preferably constructed from a sheet of thermoplastic material extruded from an extrusion apparatus such as is well known to a person of ordinary skill in the art. After extrusion, the sheet of extruded thermoplastic material is cut into individual sheet portions 11, after which a bonding material is applied to a surface of the individual sheet portion 11 to form the shipping device 10. The bonding material 24 can be applied in any acceptable manner such as spraying or brushing. Alternatively the bonding material can be provided as a sheet which is then applied to the sheet of extruded thermoplastic material. Further, release material can be disposed upon the bonding material after the bonding material is applied. The layer of release material 25 can then be removed from the shipping device 10 prior to its use. Also, as will be understood by a person of ordinary skill in the art, the bonding material 24 (and release layer 26, if used) can be applied to the sheet of extruded material before the sheet of extruded material is cut into individual sheet portions 11 for use as a shipping device 10. The bonding material may be applied to only a portion of the sheet, for example as a generally circular area near the center of the sheet, or as several circular areas disposed in a regular pattern upon the sheet.

The shipping device 10 is used to bondingly support a floral assembly 26 comprising a floral container 28 and a floral item. For example, as shown in FIG. 1A, the floral container 28 having an upper end 30 and a lower end 32 and having a floral grouping 34 disposed therein is placed upon the upper surface 20 of the shipping device 10. The release material 25, if present, is removed prior to disposing the floral container 28 on the shipping device 10. The lower end 32 of the floral container is bondingly connected to the upper surface 20 by the bonding material 24 such that the floral container 28 is firmly and securely attached in a generally upright orientation to the upper surface 20 of the shipping device 10. The floral container may be any rigid container capable of holding a floral item, and may comprise a flower pot, a vase or a bedding tray, for example, or any other floral container, such as a foam container known to one of ordinary skill in the floral industry.

Figure 3:
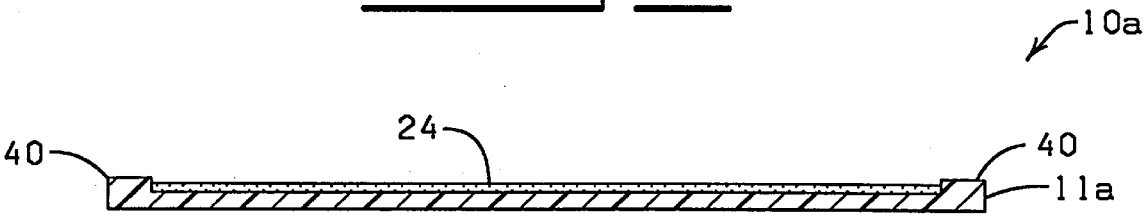
FIG. 3 is a side view of an alternate embodiment of the shipping device of the present invention.
Figure 4:
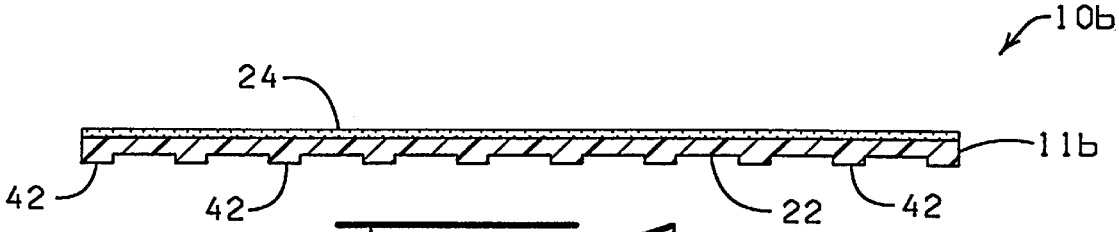
FIG. 4 is a side view of another alternate version of the shipping device of the present invention.
Figure 5:
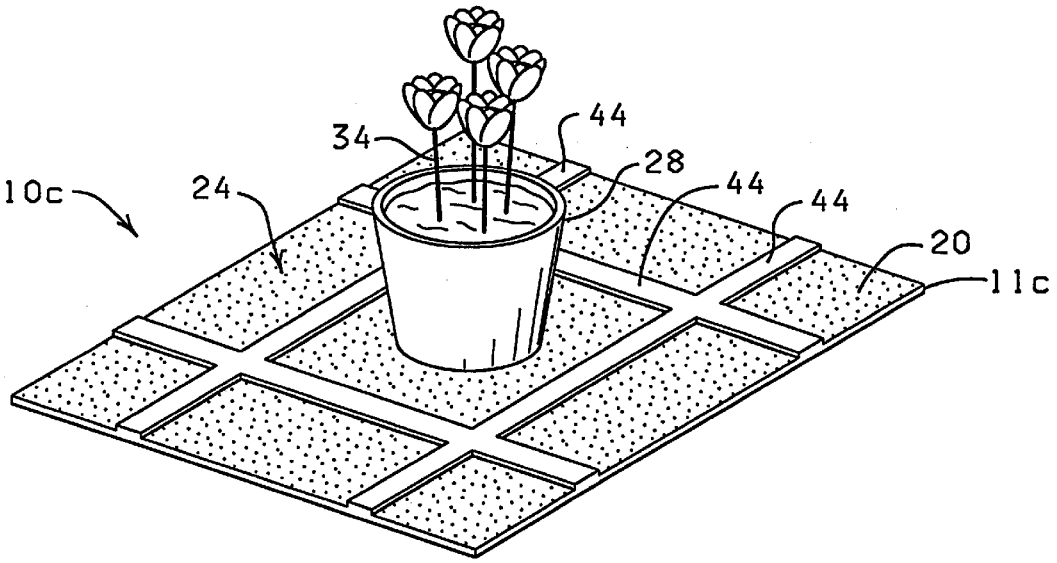
FIG. 5 is a perspective view of another version of the present invention.

Other embodiments of the invention are shown in FIGS. 3–10. FIG. 3 shows a shipping device 10*a* comprising a sheet 11*a* which is exactly the same as the device 10 shown in FIGS. 1 and 2 except device 10*a* also comprises a rim 40 which extends around the perimeter of the sheet 11*a* for catching spillage of water or growth media. FIG. 4 is exactly the same of either of devices 10 or 10*a* except for the corrugations 42 extending from the lower surface 22 of the sheet 11*b*. The corrugations 42 function to provide support and rigidity to the device 10*b*. The corrugations 42 may be formed during the extrusion process or may be applied to the lower surface 22 in a separate step. Shown in FIG. 5 is a shipping device 10*c* comprising a sheet 11*c* which is exactly the same of any of devices 10–10*b* except the device 10*c* further has support means 44 disposed on the upper surface 20 of the sheet 11*c*. These support means may comprise corrugations formed during the extrusion process or may be applied separately after the extrusion process. FIG. 5 shows but one version of the configuration of the support means 44 but one of ordinary skill in the art will readily understand that the support means 44 may comprise other patterns or configurations such as circles or diagonally-oriented members or ridges.

Figure 6:
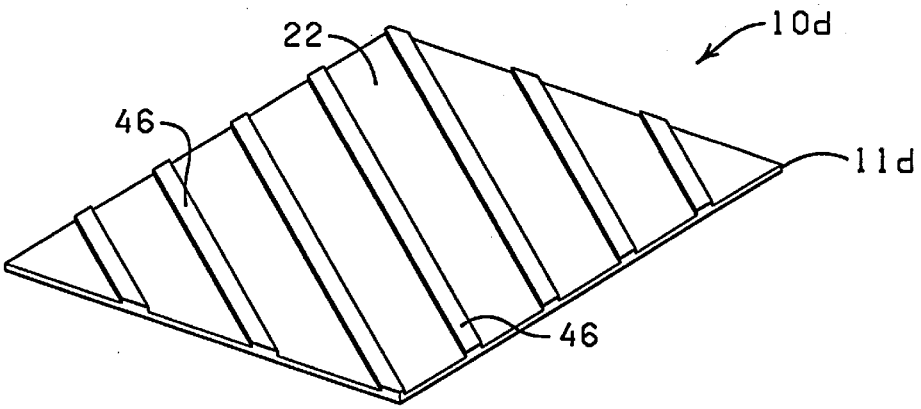
FIG. 6 is a perspective view of yet another version of the present invention.
Figure 7:
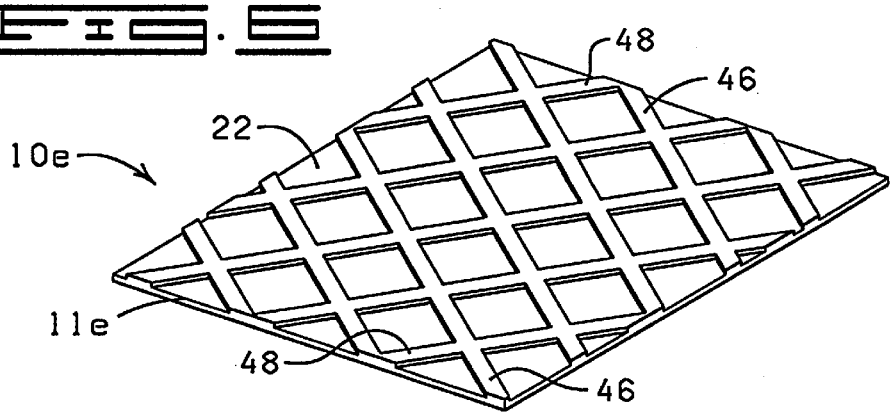
FIG. 7 is a perspective view of still another version of the present invention.

Shown in FIG. 6 is another shipping device 10*d* comprising a sheet 11*d* which is essentially the same as the shipping device 10*b* except that the device 10*d* has diagonally-oriented corrugations on the lower surface 22. Shown in FIG. 7 is a shipping device 10*e* comprising a sheet 11*e* which is the same as shipping device 10*d* except the lower surface 22 of the sheet 11*e* also has corrugations 48 which are diagonally oriented and which are oriented perpendicularly to corrugations 46 thereon, forming a criss-cross, or cross-hatching pattern, for additional support.

Figure 8:
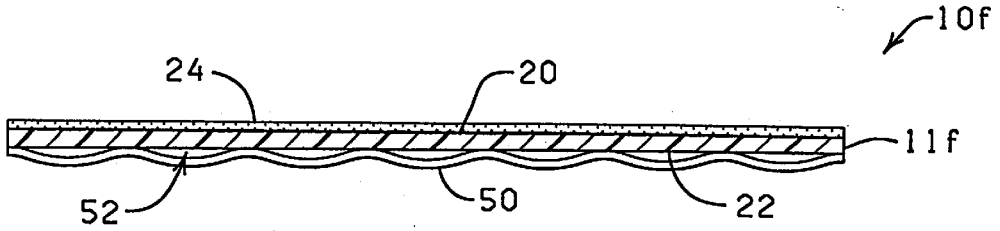
FIG. 8 is a side view of another version of the present invention.

Shown in FIG. 8 is a shipping device 10*f* exactly like any of devices 10–10*a*, or 10*c* comprising a sheet 11*f* except having corrugations 50 which enclose a plurality of void spaces 52 between the corrugations 50 and the lower surface 22 of the sheet 11*f*. In an alternative version, there may be no void spaces between the corrugations 50 and the sheet 11*f*. The shipping device 10*f* may be formed by extrusion or any other method described herein or which is known to one of ordinary skill in the art.

Figure 9:
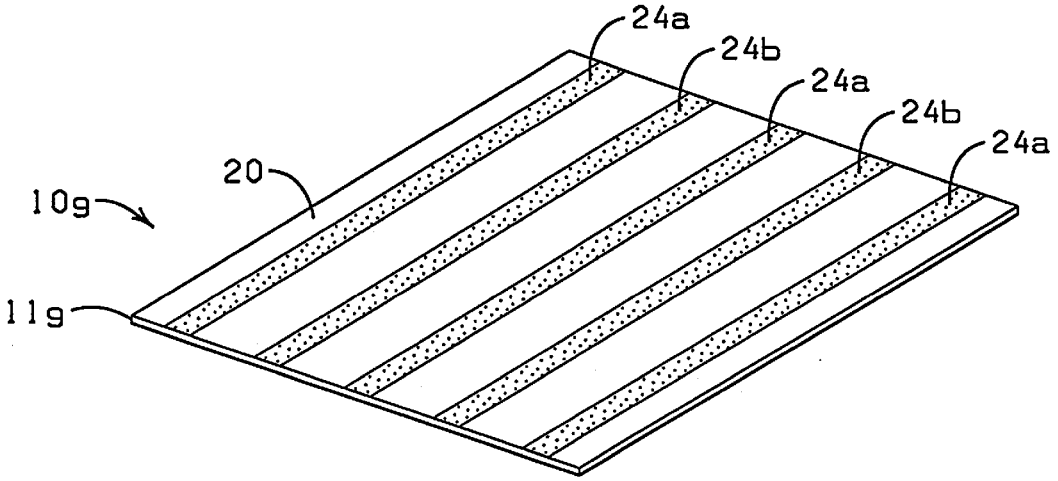
FIG. 9 is a perspective view of yet another version of the invention.
Figure 10:
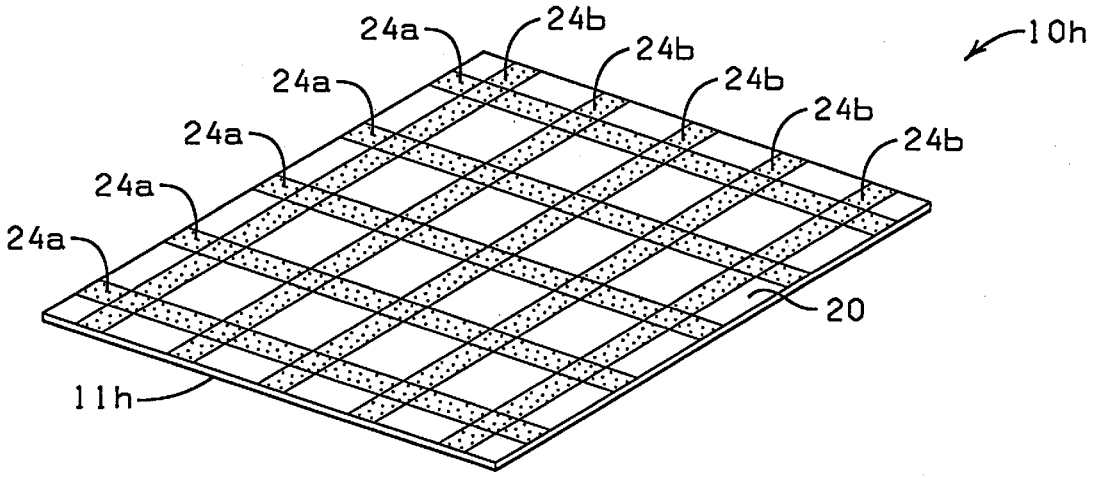
FIG. 10 is a perspective view of still another version of the invention.

Shown in FIG. 9 is a shipping device 10*g* exactly like any of devices 10–10*f* shown above except the upper surface 20 of the sheet 11*g* has alternating strips of bonding material 24*a* and 24*b* disposed thereon. The alternating strips (which may be spots rather than strips) have different properties, such as being tacky at either low or high temperatures, or having different levels of tackiness at the same temperature, as explained in further detail below. Shown in FIG. 10 is a shipping device 10*h* similar to that of device 10*g* in FIG. 9 except the strips of bonding material 24*a* and 24*b* are criss-crossed rather than parallel. Further, the crisscrossed strips may alternate in the manner of the device 10*g*. Further, the different bonding materials are at least partially disposed in separate locations on the shipping device. The term "separate locations" means that at least a portion of the shipping device is covered only by one type of bonding material and at least another portion of the shipping device is covered by a different type of bonding material. Included in this definition are different, yet abutting, bonding materials disposed on the bonding surface. A variety of other arrangements of the bonding material will be readily apparent to the person of ordinary skill in the art.

The floral assembly 26 attached to any of shipping devices 10–10*h* is rendered substantially immobile thereupon and may be further cushioned, protected, or immobilized by packing material (not shown) disposed about the floral assembly 26. Such packing materials are well known to those of ordinary skill in the art.

The shipping device 10–10*h* may be any shape which functions in accordance with the present invention. The shipping device 10–10*h*, may, for example, be square, rectangular, circular or any other geometric shape which enhances the function of the sheet for the purpose disclosed herein. The shipping device 10–10*h* may be plastic, thermoplastic, resin, recycled resin, or any moldable, rigid or semi-rigid material. The shipping device 10–10*h* may be a laminar combination of any of the above materials and may be constructed by methods other than extrusion, such as molding. Any thickness of the shipping device 10–10*h* may be utilized in accordance with the present invention as long as the shipping device 10–10*h* functions to support the floral assembly disposed thereupon. Preferably the shipping device 10–10*h* is thin to reduce its weight, and the corrugations or other support members are intended to enhance the strength and rigidity of a thin shipping device.

The term vase, flower pot, or bedding tray refers to any type of container used for holding the floral grouping or single floral cuttings. "Floral item" or "floral grouping" as used herein means cut fresh flowers, bedding plants, cuttings, entire plants, artificial flowers, a single flower either fresh and/or artificial plants or other floral materials and may include other secondary plants and/or ornamentation or artificial or natural materials which add to the aesthetics of the overall floral arrangement. The floral grouping generally comprises a bloom or foliage portion and a stem portion. However, it will be appreciated that the floral grouping may consist of only a single bloom or only foliage (not shown). The term "floral grouping" may be used interchangeably herein with the term "floral arrangement".

The sheets which comprise shipping devices 10–10*h* could be stacked together, attached or unattached into a pad. Alternatively, the sheets could be provided in a roll having score marks or perforations for easy separation, or the individual sheet portions of the roll could be cut or severed from the roll at the point of use.

In some embodiments it may be preferred that the bonding material be an adhesive which maintains its tackiness at low temperatures, e.g., near or below 32° F. Such adhesives are well known in the art, and an example of such an adhesive is Adhesive No. 9211 supplied by Dyna-Tech Adhesives of Grafton, W.V. In other embodiments it may be preferable to use an adhesive which maintains its tackiness even at the high temperatures that might be encountered in a delivery truck on a hot summer day, such as about 120°–130° F. Such adhesives are also known in the art and an example of such an adhesive is Adhesive No. 9410DL from Dyna-Tech. Most preferable would be to have a bonding material on the shipping device which would be functional in both of the temperature regimes described above, for example wherein the tackiness of the adhesive is maintained from about 25° F. to about 130° F. Such an adhesive can be obtained by mixing adhesive 9211 and 9410DL in approximately equal proportions. As will be readily appreciated by one of ordinary skill in the art, any number of adhesive or cohesive bonding materials are commercially available which would function in accordance with the present invention as described herein, as long as they firmly adhere to the upper surface and to the object disposed thereon.

In an alternative embodiment of the invention, two or more bonding materials with differing levels of tackiness or differing tack properties may be applied to the same bonding surface of the shipping device 10. For example, the bonding surface may have strips or spots of adhesive having a low-temperature tackiness (e.g., Dyna-Tech 9211) and also may have strips or spots of adhesive having a high-temperature tackiness (e.g., Dyna-Tech 9410DL). The spots or strips may alternate with each other (FIG. 9), or may crisscross (FIG. 10). Also, it may be preferable to employ different adhesives having different adhesive properties when "wet" and "dry". For example an adhesive which continues to be tacky even when wet for holding a wet object could alternate with an adhesive which is most tacky when dry for holding a dry object. Or adhesives having higher tackiness could alternate with adhesives having lower tackiness.

Also, fragrances, insect repellents, and pheromones may be provided on the shipping device to attract or repel insects, animals, or humans. Further, the different types of bonding material may have different colors to facilitate identification of which strip of bonding material has a particular bonding property, such as bonding ability at low temperatures. Further, combinations of shipping devices having different properties and/or sheets with different properties could be provided together as a kit (e.g., in a connected or unconnected pad).

Another use for the device described herein is as a base on which small houses, scenes, etc. could be created or placed. The adhesives with a coated base would provide a means for decorating an area so as to create a scene or display a house or other object. This area could be partly or entirely adhesively coated and materials such as grasslike materials, miniature animals and humans, trees and grass, and other small items could also be applied. They would be held in place by the adhesively coated surface.

The term "bonding material or bonding means" when used herein means an adhesive, frequently a pressure sensitive adhesive, or a cohesive or any other bonding material which functions as a bonding material in accordance with the invention described herein. When the bonding material is a cohesive, a similar cohesive material must be present on a surface of the object which will be disposed on the bonding surface of the shipping device. Preferably, when the bonding material is an adhesive, the cohesive forces between adhesive molecules within the foam are stronger than the adhesive forces between the adhesive and the item placed thereon so that when the floral assembly is removed from the shipping device 10 a minimum of adhesive is left on the floral assembly.

It will be appreciated by one of ordinary skill in the art that the container 28 displayed in FIG. 1 is but one of the great variety of shapes of objects, items or containers which may be used in accordance with the present invention.

The term "floral grouping" or "floral item" when used herein generally means a plant having a bloom portion and a stem portion. Further, the floral grouping 34 may comprise a root portion (not shown) as well. However, it will be appreciated that the floral grouping may consist of only a single bloom or only foliage, or a botanical item (not shown), or a propagule (not shown). The term "floral grouping" may also be used interchangeably herein with the terms "botanical item" and/or "propagule" and may include a plant having only foliage and no blooms.

The term "growing medium" when used herein means any liquid, solid or gaseous material used for plant growth or for the cultivation of propagules, including organic and inorganic materials such as soil, humus, perlite, vermiculite, sand, water and including the nutrients, fertilizers or hormones or combinations thereof required by the plants or propagules for growth. The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping. The term "propagule" when used herein means any structure capable of being propagated or acting as an agent of reproduction including seeds, shoots, stems, runners, tubers, plants, leaves, roots or spores.

Changes may be made in the construction and the operation of the various components, elements and assemblies described herein or in the steps or the sequence of steps of the methods described herein without departing from the spirit and scope of the invention as defined in the following claims.

What is claimed is:

1. A method of preparing a floral assembly for shipping, comprising:

extruding a thermoplastic material into a sheet;

applying a bonding material to a surface of the sheet;

separating a portion of the sheet into an individual sheet portion having a bonding surface and having the bonding material on the bonding surface wherein said sheet portion and bonding material comprise a shipping device;

providing a floral assembly comprising a floral container and a floral item; and placing the floral assembly upon the bonding surface of the shipping device and bondingly connecting the floral assembly to the shipping device via the bonding material on the bonding surface.

2. The method of claim 1 wherein in the step of applying a bonding material, the bonding material is a pressure sensitive adhesive or cohesive material.

3. The method of claim 1 wherein in the step of placing the floral container, the floral container comprises a connecting bonding material disposed upon a portion thereof for cooperating with the connecting bonding material of the shipping device to bondingly connect the floral container to the bonding surface.

4. The method of claim 1 wherein in the step of placing the floral assembly, the floral container is a flower pot, a vase, or a bedding tray.

5. The method of claim 1 further comprising the step of transporting the shipping device and floral assembly secured thereto to a predetermined destination.

6. The method of claim 1 further comprising the step of applying a removable release material to the bonding material.

7. The method of claim 1 wherein the bonding material disposed on the shipping device comprises at least a first bonding material and a second bonding material which are at least partially disposed in different locations on the shipping device and which have different bonding properties.

8. A shipping assembly, comprising:

a shipping device comprising a support surface constructed from an extruded thermoplastic material having an upper bonding surface comprising a connecting bonding material disposed thereon; and a floral assembly placed upon the upper bonding surface of the shipping device and bondingly connected thereto via the connecting bonding material wherein the floral assembly is secured to the shipping device for shipment, the floral assembly comprising a floral container and a floral item disposed therein.

9. The shipping device of claim 8 wherein the connecting bonding material is a pressure sensitive adhesive or cohesive material.

10. The shipping assembly of claim 8 wherein the floral container comprises a connecting bonding material disposed upon a portion thereof for cooperating with the connecting bonding material of the shipping device to bondingly connect the floral container to the bonding surface.

11. The shipping assembly of claim 8 wherein the floral container is a flower pot, a vase, or a bedding tray.

12. A shipping device, comprising:

a support surface constructed from a thermoplastic or resinous material having an upper bonding surface comprising a connecting bonding material disposed thereon; and wherein the connecting bonding material comprises at least a first bonding material and a second bonding material each of which is disposed at least partially in separate locations on the upper bonding surface and wherein the first bonding material is more tacky than the second bonding material.

13. The shipping device of claim 12 wherein each of the first and second bonding materials are pressure sensitive adhesive or cohesive materials.

14. The shipping device of claim 12 further comprising a removable release material disposed upon the connecting bonding material.

15. The shipping device of claim 12 wherein each of the first and second bonding materials are visually distinguishable from each other by differences in color or by differences in the pattern in which they are disposed on the shipping device.

16. A method of preparing a floral assembly for shipping, comprising:

extruding a thermoplastic material into a sheet;

separating a portion of the sheet to form an individual sheet portion;

applying a bonding material to a bonding surface of the individual sheet portion wherein said sheet portion and bonding material comprise a shipping device; and placing a floral assembly comprising a floral container and a floral item upon the bonding surface of the shipping device and bondingly connecting the floral assembly to the shipping device via the bonding material on the bonding surface of the shipping device.

17. The method of claim 16 wherein in the step of applying a bonding material, the bonding material is a pressure sensitive adhesive or cohesive material.

18. The method of claim 16 wherein in the step of placing the floral container, the floral container comprises a connecting bonding material disposed upon a portion thereof for cooperating with the connecting bonding material of the shipping device to bondingly connect the floral container to the bonding surface.

19. The method of claim 16 wherein in the step of placing the floral assembly, the floral container is a flower pot, a vase, or a bedding tray.

20. The method of claim 16 further comprising the step of transporting the shipping device and floral assembly secured thereto to a predetermined destination.

21. The method of claim 16 further comprising the step of applying a removable release material to the bonding material.

22. The method of claim 16 wherein the bonding material disposed on the shipping device comprises at least a first bonding material and a second bonding material which are at least partially disposed in different locations on the shipping device and which have different bonding properties.

23. A shipping assembly, comprising:

a shipping device comprising a support surface constructed from a thermoplastic material having an upper bonding surface comprising a connecting bonding material disposed thereon and a lower surface and wherein at least one of the upper bonding surface and the lower surface further comprises a plurality of ridges, corrugations or raised portions; and a floral assembly placed upon the upper bonding surface of the shipping device and bondingly connected thereto via the connecting bonding material wherein the floral assembly is secured to the shipping device for shipment, the floral assembly comprising a floral container and a floral item disposed therein.

24. The shipping device of claim 23 wherein the connecting bonding material is a pressure sensitive adhesive or cohesive material.

25. The shipping assembly of claim 23 wherein the floral container comprises a connecting bonding material disposed upon a portion thereof for cooperating with the connecting bonding material of the shipping device to bondingly connect the floral container to the bonding surface.

26. The shipping assembly of claim 23 wherein the floral container is a flower pot, a vase, or a bedding tray.

27. A shipping device, comprising:

a support surface constructed from a thermoplastic or resinous material having an upper bonding surface comprising a connecting bonding material disposed thereon; and wherein the connecting bonding material comprises at least a first bonding material and a second bonding material each of which is disposed at least partially in separate locations on the upper bonding surface and wherein the first bonding material is more tacky than the second bonding material when the first bonding material and the second bonding material are wet.

28. The shipping device of claim 27 wherein each of the first and second bonding materials are pressure sensitive adhesive or cohesive materials.

29. The shipping device of claim 27 further comprising a removable release material disposed upon the connecting bonding material.

30. The shipping device of claim 27 wherein each of the first and second bonding materials are visually distinguishable from each other by differences in color or by differences in the pattern in which they are disposed on the shipping device.

31. A shipping device, comprising:

a support surface constructed from a thermoplastic or resinous material having an upper bonding surface comprising a connecting bonding material disposed thereon; and wherein the connecting bonding material comprises at least a first bonding material and a second bonding material each of which is disposed at least partially in separate locations on the upper bonding surface and wherein the first bonding material is more tacky than the second bonding material at a high temperature range.

32. The shipping device of claim 31 wherein each of the first and second bonding materials are pressure sensitive adhesive or cohesive materials.

33. The shipping device of claim 31 further comprising a removable release material disposed upon the connecting bonding material.

34. The shipping device of claim 31 wherein each of the first and second bonding materials are visually distinguishable from each other by differences in color or by differences in the pattern in which they are disposed on the shipping device.

35. A shipping device, comprising:

a support surface constructed from a thermoplastic or resinous material having an upper bonding surface comprising a connecting bonding material disposed thereon; and wherein the connecting bonding material comprises at least a first bonding material and a second bonding material each of which is disposed at least partially in separate locations on the upper bonding surface and wherein the first bonding material is more tacky than the second bonding material at a low temperature range.

36. The shipping device of claim 35 wherein each of the first and second bonding materials are pressure sensitive adhesive or cohesive materials.

37. The shipping device of claim 35 further comprising a removable release material disposed upon the connecting bonding material.

38. The shipping device of claim 35 wherein each of the first and second bonding materials are visually distinguishable from each other by differences in color or by differences in the pattern in which they are disposed on the shipping device.

* * * * *

UNITED STATES PATENT AND TRADEMARK OFFICE

CERTIFICATE OF CORRECTION

PATENT NO. : 5,878,883

DATED : March 9, 1999

INVENTOR(S) : Donald E. WEDER

It is certified that error appears in the above-identified patent and that said Letters Patent is hereby corrected as shown below:

Cover Page:

After the entry of the Assignee and before entry of the Appl. No., insert --* This patent is subject to a Terminal Disclaimer--.

In the Description

Col. 1: line 18, delete "side" and substitute --cross-sectional-- therefor; and delete "FIG. 1." and substitute therefor --FIG. 1, taken along line 2-2 thereof.--;

line 62, after "material" and before "is" insert --24--;

line 63, after "surface" and before "of" insert --20 and/or 22--;

line 66, after "material" and before "can" insert --24--;

Col. 2: line 1, after "material" and before "can" insert --25-- ;

line 2, after "material" (both occurrences) insert --24--;

line 6, delete "26," and substitute therefor --25,--;

line 9, after "material" and before "may" insert --24--;

line 10, delete "sheet," and substitute therefor --sheet 11,--;

line 11, delete "sheet," and substitute therefor --sheet 11,--;

UNITED STATES PATENT AND TRADEMARK OFFICE

CERTIFICATE OF CORRECTION

PATENT NO. : 5,878,883

DATED : March 9, 1999

INVENTOR(S) : Donald E. WEDER

It is certified that error appears in the above-identified patent and that said Letters Patent is hereby corrected as shown below:

Col. 2 (continued)

line 13, delete "sheet." and substitute therefor --sheet 11.--;

line 16, delete "FIG. 1A," and substitute therefor --FIG. 1,--;

line 22, after "container" and before "is" insert --28--;

line 26, after "container" and before "may" insert --28--;

line 37, delete "the same of" and substitute therefor --the same as--;

line 44, delete "the same of" and substitute therefor --the same as--;

line 57, after "corrugations" and before "on" insert --46--;

Col. 3: line 19, delete "device." and substitute therefor --device **10*h***.--;

line 21, after "device" and before "is" insert --**10*h***--;

line 47, after "assembly" and before "disposed" insert --26--;

UNITED STATES PATENT AND TRADEMARK OFFICE

CERTIFICATE OF CORRECTION

PATENT NO. : 5,878,883
DATED : March 9, 1999
INVENTOR(S) : Donald E. WEDER

It is certified that error appears in the above-identified patent and that said Letters Patent is hereby corrected as shown below:

Col. 4: line 47, after "device" and before "to" insert --10--;

line 52, after "devices" and before "having" insert --10--; and

Col. 5: line 14, after "the" and before "container" insert --floral--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*